United States Patent [19]

Lee

[11] Patent Number: 4,733,681

[45] Date of Patent: Mar. 29, 1988

[54] COMBINATION DEVICE OF UMBRELLA AND GOLF BALL RETRIEVER

[76] Inventor: Ching C. Lee, No. 281, Cherng Der Road, Taipei, Taiwan

[21] Appl. No.: 806,901

[22] Filed: Dec. 9, 1985

Related U.S. Application Data

[63] Continuation-in-part of Ser. No. 737,345, May 23, 1985, Pat. No. 4,659,125.

[51] Int. Cl.[4] ..... A45B 3/00; A45B 21/00; A63B 71/00; A47J 45/00

[52] U.S. Cl. ..... 135/16; 135/19; 273/32 F; 294/19.2; 403/104; 403/352

[58] Field of Search ..... 135/16, 19, 23, 75; 403/104, 352; 135/17, 18, 19.5; 294/19.2; 273/32 F

[56] References Cited

U.S. PATENT DOCUMENTS

| | | | |
|---|---|---|---|
| 1,532,802 | 4/1925 | Feistner | 135/16 |
| 2,063,624 | 12/1936 | Raab et al. | 135/75 |
| 2,168,188 | 8/1939 | Bernhard | 135/75 X |
| 2,289,134 | 7/1942 | Loria | 135/16 |
| 2,346,038 | 4/1944 | Mason | 135/66 X |
| 2,443,772 | 6/1948 | Mappin | 135/20 R X |
| 2,915,327 | 12/1959 | Kreske | 403/104 |
| 3,093,402 | 6/1963 | Sisson | 135/66 X |
| 3,136,573 | 6/1964 | Harke | 294/19.2 |
| 3,442,544 | 5/1969 | Faber | 294/19.2 |
| 3,467,116 | 9/1969 | Ringewaldt | 135/66 X |
| 3,935,874 | 2/1976 | Cohen | 135/16 |
| 3,953,138 | 4/1976 | Hine et al. | 403/104 X |
| 4,105,346 | 8/1978 | Gelinas | 403/352 X |
| 4,154,545 | 5/1979 | Pinto et al. | 403/104 |
| 4,508,467 | 4/1985 | Choffin | 403/104 |
| 4,509,751 | 4/1985 | Tabet | 273/32 F X |
| 4,585,367 | 4/1986 | Gall | 403/104 |
| 4,596,405 | 6/1986 | Jones | 135/75 X |

FOREIGN PATENT DOCUMENTS

| | | | |
|---|---|---|---|
| 479163 | 12/1951 | Canada | 403/104 |
| 2561323 | 9/1985 | France | 403/104 |
| 1087935 | 10/1967 | United Kingdom | 403/104 |

*Primary Examiner*—Robert A. Hafer
*Assistant Examiner*—D. Neal Muir
*Attorney, Agent, or Firm*—Armstrong, Nikaido, Marmelstein & Marmelstein

[57] ABSTRACT

A combination umbrella and golf ball retriever which uses the umbrella strut as a socket pipe to accommodate several telescopically nested tubes so as to form an elongated handle for a golf ball retriever. There is an eccentric-grooved stud inserted at one end of the inside tube of each two neighboring tubes. The eccentric-grooved portion of this stud matches with a similar eccentric circular bushing. When the inner tube turns to one direction, the outside part of the circular bushing will press tightly against the inner wall of the outside tube and lock up the two neighboring tubes. An opposite turn at the inner tube will set loose the circular bushing and allow both neighboring tubes to slide in and out freely so as to adjust the length of the handle of the golf ball retriever.

2 Claims, 8 Drawing Figures

COMBINATION DEVICE OF UMBRELLA AND GOLF BALL RETRIEVER

This application is a continuation-in-part of application Ser. No. 737,345 filed May 23, 1985, now issued as U.S. Pat. No. 4,659,125.

BACKGROUND OF THE INVENTION

This invention relates to a combination device of umbrella and golf ball retriever which uses the umbrella strut as a socket pipe to accommodate several telescopically nested tubes so as to form an elongated handle for a golf ball retriever. Each two neighboring tubes can be locked up or released for sliding by turning in different directions.

Golfing has become more and more popular nowadays. The golf players have to carry pretty many items around the wide-open courts such as clubs, umbrella and ball retriever etc. It should be wise to combine some items together to save space and energy and eventually reduce the total load. However, the extensible handle of the ball retriever must be well designed so as to avoid any troubles for the normal operation. Such a handle structure is disclosed in co-pending application Ser. No. 737,345.

SUMMARY OF THE INVENTION

The main object of this invention is to provide a combination device of umbrella and golf ball retriever by availing the main strut of the umbrella as a socket pipe to accommodate the extensible nested tubes for forming a handle for golf-retrieving. There is an eccentric-grooved stud inserted at one end of the inner tube of each two neighboring tubes. The eccentric-grooved portion of the stud matches with a similar eccentric circular bushing. Each two neighboring tubes can be locked up or released freely for sliding by the eccentric action between the eccentric-grooved portion of the stud and the circular bushing when they are turned in opposite directions to each other.

These and many other advantages, features and objects of the present invention will be apparent from the following brief description of drawings, detailed description of the preferred embodiment and the appended claims.

BRIEF DESCRIPTION OF THE DRAWINGS

FIG. 4-1 illustrates a sectional view along A—A line of FIG. 4.

FIG. 5-1 illustrates a sectional view along B—B line of FIG. 5.

DETAILED DESCRIPTION OF THE PREFERRED EMBODIMENT

This invention comprises two major components: an umbrella F and golf ball retriever. The main strut A of the umbrella serves as the socket pipe for all the telescopically nested tubes for forming a handle for the golf ball retriever. All these tubes are nested in sequence (see FIG. 1), i.e. the umbrella strut A is the mother pipe to house tube B, and tube B houses tube C. The preferred number of the tubes is three or four. At the end of the smallest tube, a golf ball retriever head E is installed.

Figure 3:
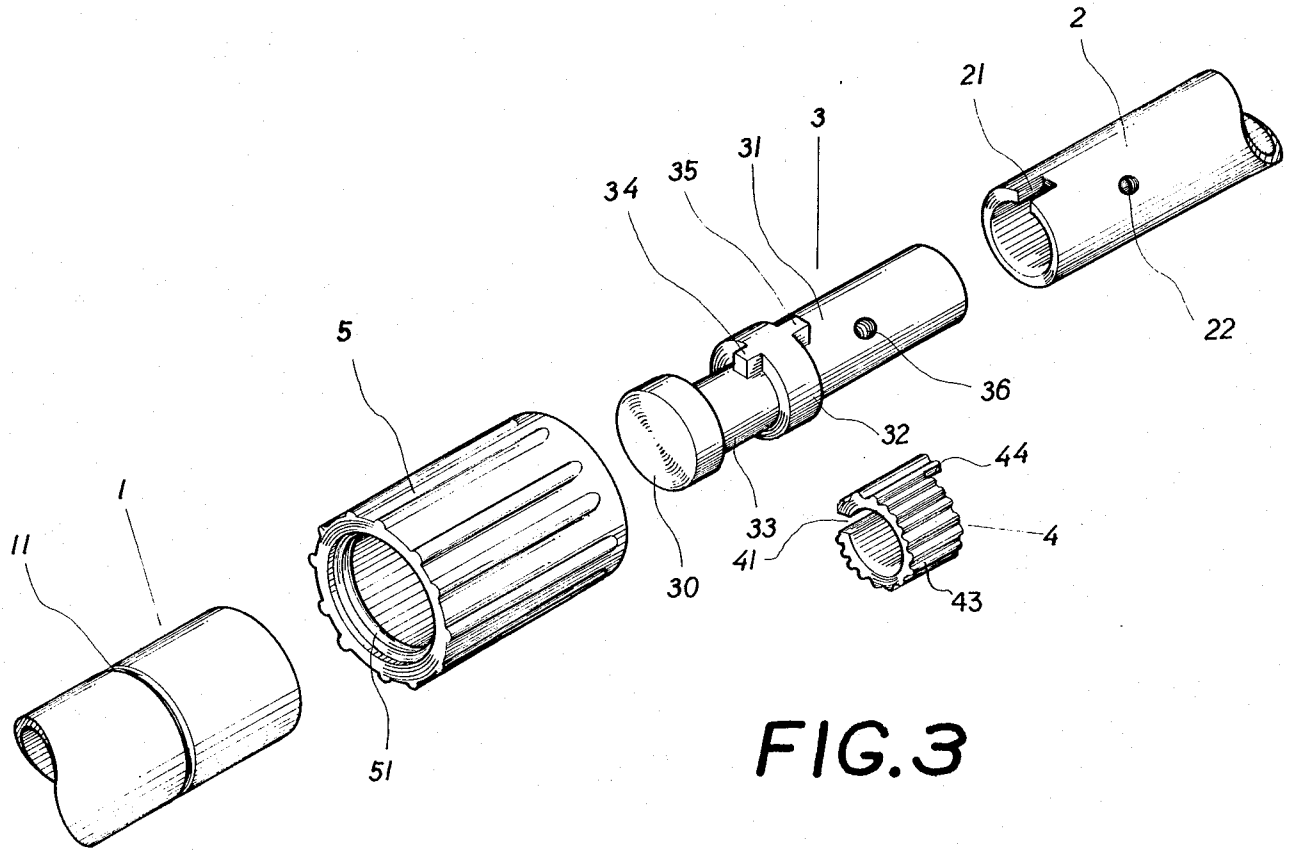
FIG. 3 shows the main parts in each two neighboring tubes inside the main strut of the umbrella portion.

In each two nested neighboring tubes, there are an outer tube 1, an inner tube 2, a stud 3, a circular bushing 4 and a ferrule 5 etc. (see FIG. 3). There is a groove 11 at the proper part of outer tube 1. The inner tube 2, a little smaller than the inside diameter of outer tube 1, can be inserted into outer tube 1 from one end. There are a notch 21 on top of the inserting end of inner tube, and two sunk spots 22 on the outside surface of the inner tube. (two exposed spots relatively formed on the inside wall of inner tube). Stud 3, having a short piece of generally cylindrical body 31 with similar size as the inside diameter of the inner tube 2, can be partly inserted into the inner tube. There are two sunk spots 36 on the stud with positions corresponding to sunk spots 22 of the inner tube. Such sunk spots, 36 and 22, can be made by punchings from outside after the stud was inserted. When sunk spots 22 of the inner tube and 36 of the stud match with each other, the tube and the stud can be locked up to avoid sliding between inner tube 2 and stud 3. In this case, whenever the inner tube turns, the stud will go with it. On the farther end (relative to inner tube 2) of the stud, there are formed a ring cap 30 and an exposed ring 32 which has lugs 34 and 35. Between ring cap 30 and exposed ring 32, there is formed an eccentric groove 33 to hold the circular bushing 4 in place. The sizes of ring cap 30 and exposed ring 32 are just fitted to insert into outer tube 1, wherein the lug 35 is matched with the notch 21 of the inner tube. As for circular bushing 4, there exists an opening 41 along the axial direction, and the bushing is formed in the same eccentricity as the groove 33 (in the embodiment as shown in FIG. 3, the portion near the opening 41 is thicker than that of the farther portion).

Figures 1, 2:
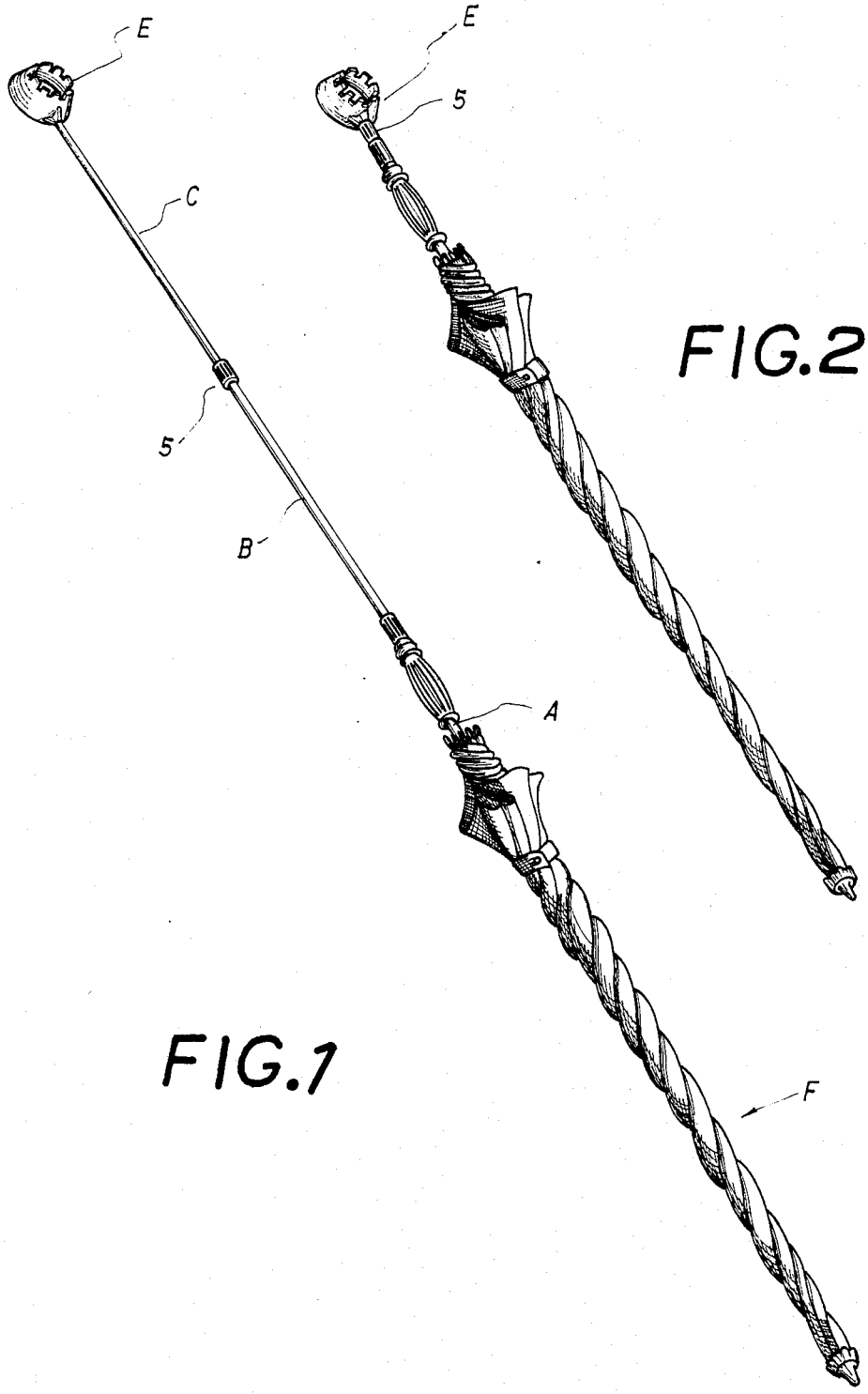
FIG. 1 is a perspective view showing the extended handle for the golf ball retriever of the preferred embodiment of the present invention.
FIG. 2 is a perspective view showing the retracted handle for the golf ball retriever of the preferred embodiment of the present inventions.
Figures 1, 5:
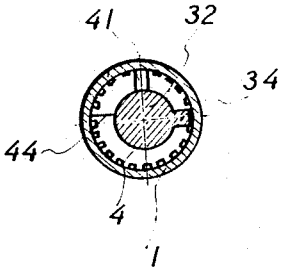
FIG. 5 illustrates a sectional view showing the joint portion of each two neighboring tubes, wherein the circular bushing presses tightly against the inner wall of the outside tube.
Figures 1, 4:
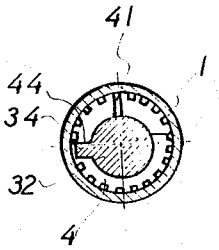
FIG. 4 illustrates a sectional view showing the joint portion of each two neighboring tubes, wherein circular busher is off the inner wall of the outside tube.
Figure 5:
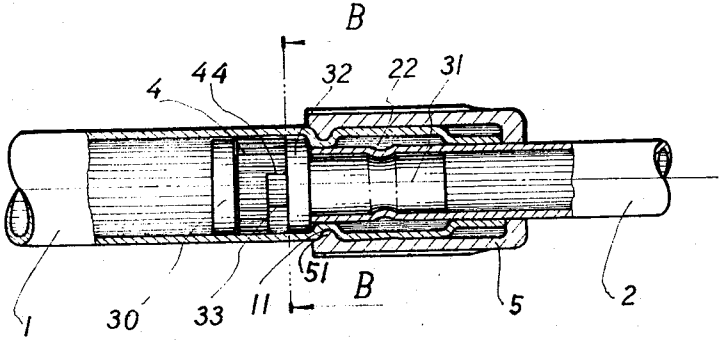
Figure 4:
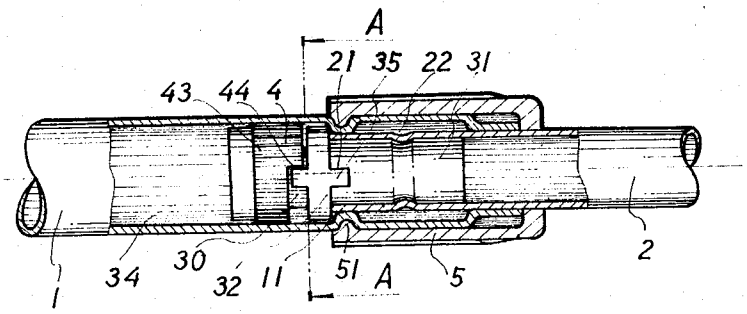

The outside surface 43 of the circular bushing (see FIG. 4) is made corrogated with a lug 44 along the axial direction of one side of opening 41. A circular flange lip 51 is formed inside the ferrule 5, and fixed in groove 11 of the outer tube 1 and joined with groove 11 further by a chemical agent. Ferrule 5 is also made corrogated which can be easily held by users for adjustment. While in use, due to the fact that groove 33 can match with circular bushing 4 and the lug 34 of stud 3 can hold the lug 44 of the circular bushing by one way turning, the outer surface of stud 3 and the circular bushing 4 will be of the same size circle (No eccentricity), and the outer and inner tubes are in loose condition with each other as shown in FIG. 4 and FIG. 4-1. The length of the handle for the golf ball retriever can be freely adjusted. But when inner tube 2 turns to the opposite direction, the circular bushing 4 will press tightly against the inside wall of outer tube 1 owing to the gradual eccentricity caused by relative movement between stud 3 and circular bushing 4, as shown in FIG. 5 and FIG. 5-1. Thus, inner tube 2 can be locked up inside outer tube 1. Likewise, if it turns to the other direction again, the tubes will restore to loose condition and become adjustable again.

Figure 6:
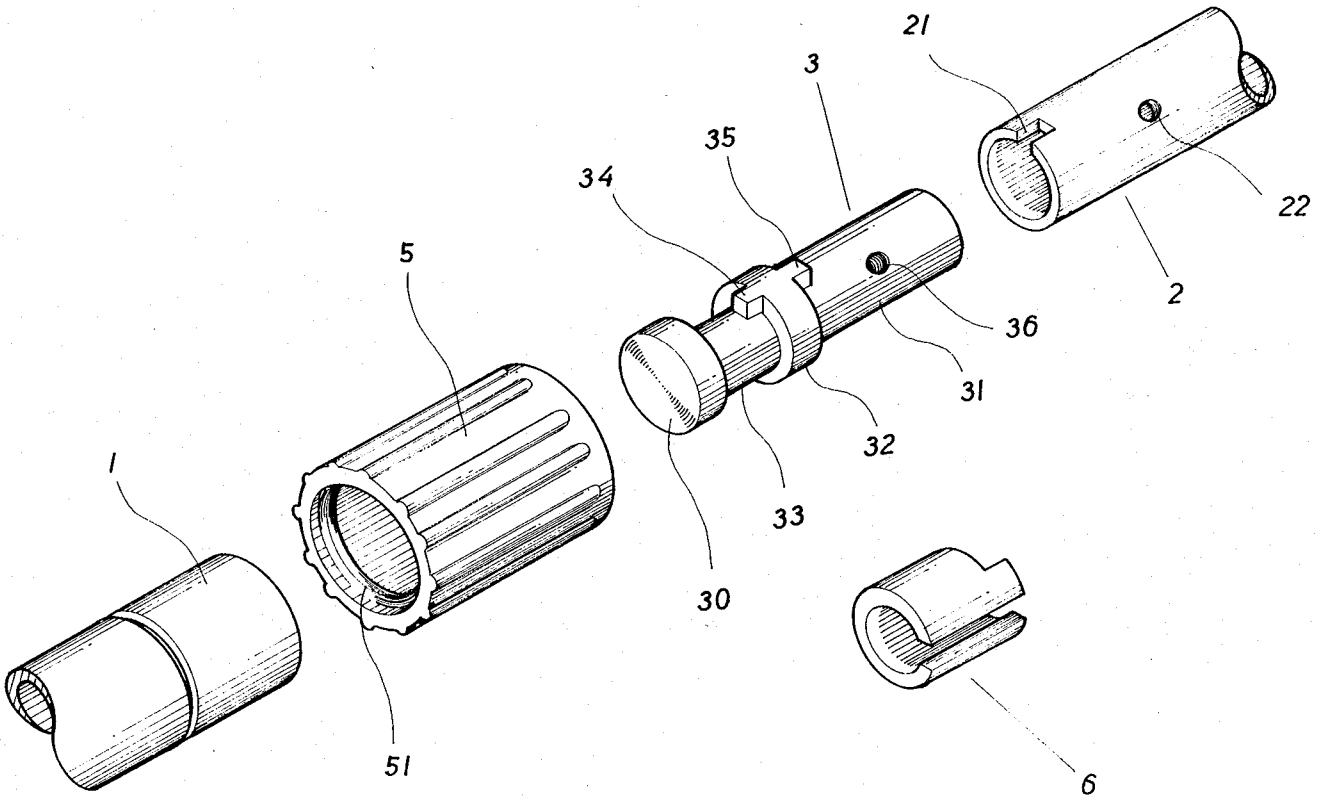
FIG. 6A prespective view of another embodiment of a circular bushing.

As stated above, all the main operational functions of this invention are covered. Other optionals such as the fixing stud 3 with inner tubes 2, the method of surface treatment of circular bushing, corrogated or smooth bushing shown in FIG. 6 are also included in the scope of the structural conception. In this invention, the main strut of the umbrella can accomodate the telescopically extensible nested tubes for a golf ball retriever, special studs and circular bushings are installed between the outer and inner tubes to function such that these tubes can be quickly locked up or set loose by relative turnings. The stable reliability, simple structure and easy operation must result in remarkable and practical value.

I claim:

1. A combination umbrella and golf ball retriever comprising:

an umbrella having a hollow tubular member serving as a main strut thereof, said tubular member being provided with a grip at an end thereof to serve as a handle for said umbrella;

a golf ball retriever formed of a plurality of telescopically nested tubular members of successively smaller diameters fitted one inside another, the smallest of said tubular members having a golf ball retriever head installed at an end thereof;

said umbrella handle and said main strut serving as a socket pipe telescopically accommodating said telescopically nested tubes of said golf ball retriever therewithin so that said umbrella handle and said umbrella when in a closed condition form an elongated handle for said golf ball retriever; and releasable locking means arranged between each contiguous pair of said telescopic tubular members of the umbrella and the golf ball retriever whereby each of said members may be released to telescopically move relative to the next larger member and may be locked in a position to which it is moved.

2. A combination umbrella and golf ball retriever as recited in claim 1 wherein said releasable locking means comprises a eccentric-grooved stud inserted at one end of the inner tubular member of each contiguous pair which matches with a similar eccentric circular bushing such that rotation of said inner tubular member with respect to the outer tubular member of the pair in one direction will press an outer part of said circular bushing against an inner wall of said outer tubular member to lock said members in said position, and rotation of said inner tubular member in the opposite direction will release said bushing and allow said tubular members to slide telescopically with respect to each other.

* * * * *